US005404069A

United States Patent [19]

Olwert et al.

[11] Patent Number: 5,404,069

[45] Date of Patent: Apr. 4, 1995

[54] FILAMENT SUPPORT FOR INCANDESCENT LAMPS

[75] Inventors: Ronald J. Olwert, Concord Township, Lake County; Frederic F. Ahlgren, Euclid; Laverne E. Walsh, Chagrin Falls; Donald R. Schindler, Burton; Rolf S. Bergman; Gary L. Price, both of Cleveland Heights; Curtis E. Scott, Mentor, all of Ohio

[73] Assignee: General Electric Company, Schenectady, N.Y.

[21] Appl. No.: 224,404

[22] Filed: Apr. 7, 1994

Related U.S. Application Data

[63] Continuation of Ser. No. 859,185, Mar. 27, 1992, abandoned.

[51] Int. Cl.[6] ..... H01K 1/18

[52] U.S. Cl. ..... 313/279; 313/271

[58] Field of Search ..... 313/271, 279, 281, 578, 313/580, 315

[56] References Cited

U.S. PATENT DOCUMENTS

| | | | |
|---|---|---|---|
| 2,032,791 | 8/1933 | Cartun | 176/29 |
| 3,039,015 | 6/1962 | Jolly | 313/279 |
| 3,173,051 | 3/1965 | Berlinghof et al. | 313/279 X |
| 3,188,513 | 4/1965 | Hansler | 313/112 |
| 3,195,000 | 7/1965 | Reidenbach | 313/279 X |
| 3,286,116 | 11/1966 | Malm | 313/279 X |
| 3,392,299 | 9/1965 | Kern | 313/311 |
| 3,678,319 | 7/1972 | Notelteirs et al. | 313/279 X |
| 4,613,787 | 7/1986 | Swain | 313/579 |
| 4,661,739 | 4/1987 | Dvorak et al. | 313/333 |
| 4,806,817 | 2/1989 | Ragland, Jr. et al. | 313/279 |
| 4,868,451 | 9/1989 | Fields et al. | 313/279 |
| 4,935,662 | 6/1990 | Kachemeister, Jr. et al. | 313/279 |
| 4,942,331 | 11/1990 | Bergman et al. | 313/271 |
| 4,994,707 | 2/1991 | Stark | 313/279 X |

*Primary Examiner*—Donald J. Yusko
*Assistant Examiner*—Vip Patel
*Attorney, Agent, or Firm*—George E. Hawranko; Stanley C. Corwin

[57] ABSTRACT

An incandescent lamp containing a coiled filament within a vitreous envelope wherein the filament is supported at at least one point along its coil length by a refractory metal support wire one end of which is welded to a coil and the other end secured to the envelope wall by a glass bead. The support prevents filament sag during lamp operation and is especially useful with double-ended high intensity tungsten-halogen lamps having an elliptically shaped filament chamber with an infrared reflecting and visible light transmitting optical interference coating on the chamber.

25 Claims, 4 Drawing Sheets

Fig. 1
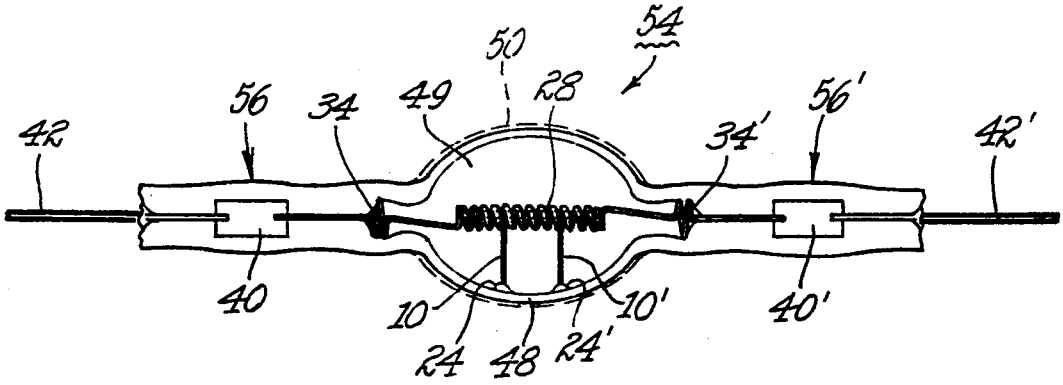
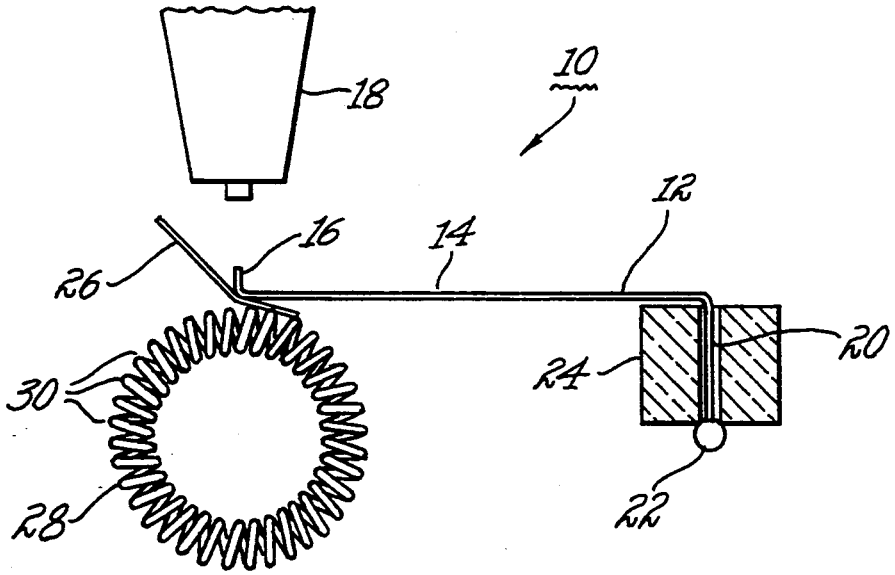
Fig. 2

Fig. 4(a)
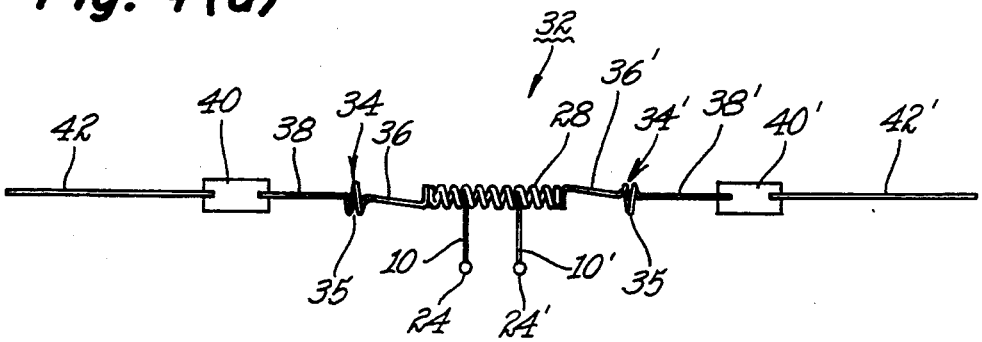
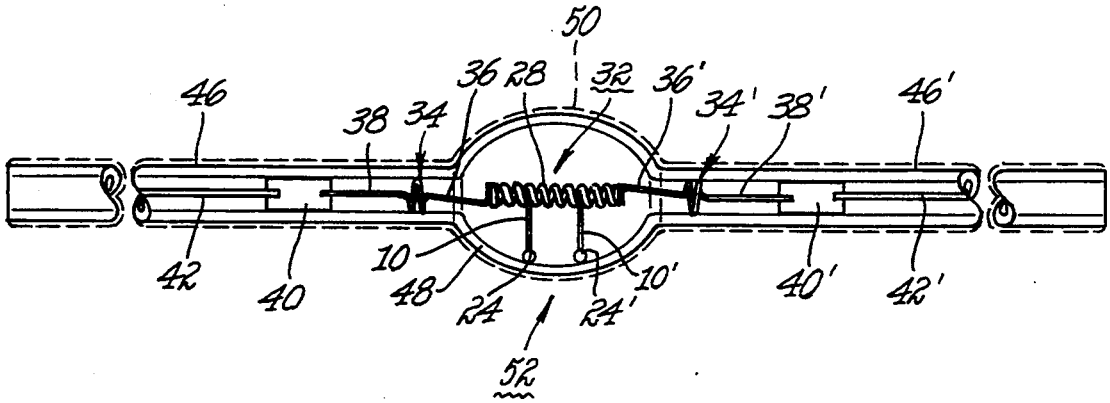
Fig. 4(b)

FILAMENT SUPPORT FOR INCANDESCENT LAMPS

This application is a continuation of application Ser. No. 07/859,185, filed Mar. 27, 1992, now abandoned.

BACKGROUND OF THE INVENTION

1. Field of the Invention

This invention relates to a filament support for an incandescent lamp. More particularly this invention relates to an incandescent lamp containing a coiled filament which is supported within a vitreous filament chamber by at least one refractory metal support wire one end of which is welded to the filament and the other end attached to the vitreous chamber.

2. Background of the Disclosure

Various types of supports for supporting a filament in an incandescent lamp are well known to those skilled in the art. These supports are invariably made of refractory metal wire such as tungsten, molybdenum, tantalum and the like which can withstand the hot temperature (i.e., 3000° K.) reached by the lamp filament without melting. Examples of typical prior art supports include wire loops or spirals adjacent the inner surface of the filament chamber and wrapped around the filament as is disclosed, for example, in U.S. Pat. Nos. 3,392,299; 3,538,374; 3,736,455 and 3,784,865. In U.S. Pat. No. 4,613,787 and in 2,032,791 a tubular incandescent lamp is disclosed having a linear filament coil supported by wire supports having one end wrapped around the filament and the other end embedded in a glass or quartz rod secured within the lamp. U.S. Pat. No. 3,188,513 is similar except that one end of each support is connected to a longitudinal support wire by a globule of glass.

All of these patents disclose supports which are used for supporting a filament in a tubular incandescent lamp and are not suitable for use with incandescent lamps wherein the entrance to the filament chamber is much smaller than the maximum diameter of the chamber. One example of such lamps are the well known double ended high intensity incandescent lamps having a spherical, elliptical or other shape filament chamber formed from a single piece of lamp tubing, wherein the maximum inner diameter of the filament chamber is greater than the inner diameter of the tubular portions which extend outwardly from each end of the filament chamber as is disclosed, for example, in U.S. Pat. No. 4,942,331. In manufacturing such lamps the filament support is inserted through one of the relatively small diameter tubular portions and into the larger filament chamber as part of the filament and foil seal assembly as is disclosed in U.S. Pat. Nos. 4,810,932 and 5,045,798.

Filament sag is particularly serious in high voltage lamps of such construction and which use thin filament wire and it is possible for the filament to sag and touch the wall of the chamber shorting the filament and/or melting the vitreous chamber wall. Further, double ended halogen-incandescent lamps having an optical interference coating or filter on the surface of the filament chamber for transmitting visible light radiation and reflecting infrared radiation back to the filament require precise radial alignment of the longitudinal axis of the filament coincident with the optical axis of the filament chamber in order to achieve maximum conversion of the infrared radiation reflected by the coating back to the filament to visible light radiation which is transmitted by the filter (i.e., see R. S. Bergman, Halogen-IR Lamp Development: A System Approach, J. of the IES, p. 10–16, Summer, 1991). Thus, there has been a need for a filament support for such double ended lamps that will prevent sagging, precisely align the filament and which can be inserted through the small diameter tubing into the larger filament chamber without breaking the filament.

SUMMARY OF THE INVENTION

The present invention relates to a coiled filament supported in an incandescent lamp by a refractory metal support which is welded to a filament coil. In one embodiment a filament is supported within a vitreous envelope by a refractory metal wire sup,port one end of which is welded to the filament and the other end attached to the envelope. The support may be attached to the vitreous envelope by a vitreous bead melted to the support and fused to the interior surface of the envelope. Thus, in an incandescent lamp according to an embodiment of the invention having a vitreous envelope which includes a filament supported within a filament chamber, one part of each filament support will be welded directly to one of the coils of a filament coil and another part embedded in a vitreous bead fused to the interior wall of the filament chamber. The support itself will generally be a wire made of a suitable refractory metal such as tungsten, molybdenum, tantalum, rhenium or alloys thereof.

This invention is useful for supporting linear filament coils in double ended incandescent lamps, such as high intensity halogen-incandescent lamps, wherein the maximum diameter of the filament chamber is substantially greater than the diameter at the end or ends of the chamber. This invention has been found to be particularly useful for high intensity incandescent halogen lamps of the double ended type having an elliptical, spherical or other shaped filament chamber the opposite ends of which terminate in tubular portions of a diameter substantially smaller than that of the filament chamber and wherein a visible light transmitting and infrared reflecting coating is disposed on the surface of the filament chamber. Such lamps have been made according to the invention with the longitudinal axis of the filament concentric within a radial distance of 20% of the filament diameter.

BRIEF DESCRIPTION OF THE DRAWINGS

FIG. 1 schematically illustrates a double ended incandescent lamp having a filament support according to the invention.

FIG. 2 illustrates an embodiment of the invention wherein a filament support wire is welded to a coil of a filament.

FIG. 4(*a*) schematically illustrates a filament, molybdenum foil seal and inlead assembly having a filament support of the invention welded to the filament coil and FIG. 4(*b*) illustrates the assembly positioned in a double ended quartz lamp envelope prior to flushing, filling and sealing the lamp and fusing the vitreous bead at the end of the filament support to the interior wall surface of the filament chamber.

DETAILED DESCRIPTION

Figure 3A:
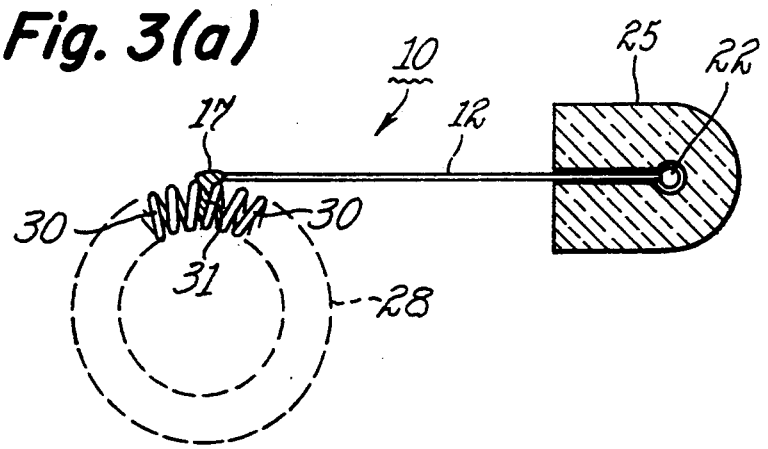
FIGS. 3(*a*) and 3(*b*) schematically illustrate two different methods used to secure a vitreous bead to the end of a filament support.

FIG. 1 schematically illustrates a double ended lamp 54 having a vitreous envelope of fused quartz which comprises filament chamber 49 and shrink sealed tubular end portions 56, 56'. The elliptical filament chamber 49 contains a coiled-coil linear filament 28. Both of the tubular end portions 56, 56' are shrink sealed over molybdenum foil members 40 and 40' to form a hermetic seal. Outer leads 42 and 42' extend past end portions 56 and 56'. Linear filament coil 28 is attached at each end to a respective filament alignment spud 34 and 34' of the type disclosed in U.S. Pat. No. 4,942,331 the disclosures of which are incorporated herein by reference, and which will be explained in greater detail below. In the embodiment shown, linear filament coil 28 is a coiled-coil tungsten filament having two tungsten filament supports 10 and 10' each welded directly to a separate secondary coil of the filament by means of a molybdenum weld explained in greater detail below, with the other end of each support 10, 10' being securely anchored to the inner wall of filament chamber 48 by means of a vitreous bead 24, 24' which has been melted around the end of each filament support 10, 10' and fused to the inner surface of the filament chamber wall 48. Coating 50 is an optical interference filter disposed on the outer surface of filament chamber 48 and reflects infrared radiation emitted by the filament back to the filament and transmits visible light radiation. In a preferred embodiment, coating 50 is preferably made up of alternating layers of a low refractory index material such as silica and a high refractory index material such as tantala, titania, niobia and the like for selectively reflecting infrared radiation and transmitting visible light radiation. However, if desired, coating 50 may be designed to selectively reflect and transmit other portions of the electromagnetic spectrum. Such optical interference filters and their use as coatings for lamps are known to those skilled in the art and may be found, for example, in U.S. Pat. Nos. 4,229,066 and 4,587,923 the disclosures of which are incorporated herein by reference. The interior of filament chamber 48 contains an inert gas such as argon, xenon, or krypton along with minor (i.e., $<12\%$) amounts of nitrogen, and one or more halogen compounds such as methylbromide, dibromomethane, dichlorobromonethane and the like and, optionally, a getter.

In a typical halogen incandescent or lamp of a type described above having an elliptical filament chamber whose dimensions are 10 mm OD and 22 mm long containing a coiled-coil tungsten filament 18 mm long, an unsupported 70 to 150 watt, 240 V filament coil will sag to the wall after about 24 hours of operation. This can result in melting of the wall and/or shorting and rupturing of the filament coil. This problem increases as the operating voltage of the lamp increases for a given size filament chamber and coil length, because as one increases the operating voltage of the lamp for a given operating wattage, the diameter of the filament wire is smaller than that for a lower voltage, while the overall length of the wire from which the filament coil is fabricated is greater. For example, for a typical lamp rated at 50 watts and 120 volts a 10 mm long coiled-coil tungsten filament will be made from tungsten wire having a diameter of about 1.9 mils and a total length of 600 mm. For the same type of lamp rated at 100 watts and 120 volts, the filament wire diameter will be about 3 mils, but with a total wire length of about 800 mm. In marked contrast, a lamp rated at 100 watts and 245 volts will have a wire diameter of 1.9 mils and a total wire length of 1400 millimeters. Coiling this length of wire in the same manner as above gives a coil 18 mm long. Thus, going from 100 watts and 120 volts to 100 watts and 245 volts results in a total wire length increase of 75% and a decrease in the wire diameter by almost 40%. One can therefore appreciate why a higher voltage rated filament coil will tend to sag more than one rated for operation at a lower voltage. Hence a filament support is essential for the successful manufacture and operation of such high voltage lamps.

Halogen-incandescent lamps were made of the type illustrated in FIG. 1 and described above were fabricated from fused quartz lamp tubing and had an elliptical filament chamber 10 mm$\times$22 mm containing a coiled-coil tungsten filament 18 mm long radially aligned along the longitudinal optical axis of the elliptical filament chamber. That is, the longitudinal axis of the filament was substantially coincident with the longitudinal optical axis of the filament chamber. These lamps were made rated at 70 and 100 watts and operating voltage of 240 V. The filament in each lamp was supported by two filament supports each made of tungsten wire 5 mils diameter welded with molybdenum to a separate secondary coil turn at one end of the support and the other end of the support wire enclosed in a vitreous bead melted to that end and fused to the filament chamber inner wall.

Turning now to FIG. 2, refractory metal support assembly 10 is schematically illustrated as refractory metal wire 12 having a 5 mil diameter with support portion 14 being 4 mm long and terminating at one end in leg 16 which is about 0.5 mm long and offset at an angle of about 110° to the leg 14. This portion of the support assembly 10 is placed adjacent to a secondary coil turn of a linear tungsten filament coil which is schematically shown as a secondary coil 28 consisting of a multiple number of primary coils 30. The outer diameter of secondary coil 28 is 58 mils and the tungsten filament wire employed to make the coils has a diameter of 2 mils. A plasma torch 18 having a tip ID of 32 mils is placed approximately 1 mm from the free end of leg 16 as shown in FIG. 2 and molybdenum wire 26 being 5 mils in diameter is placed adjacent coil 28 at that point where leg 14 is adjacent to and touches the coil. An inert cover gas such as argon is discharged from the end of plasma torch 18 and preferably containing a small percentage (5%) of hydrogen to provide a reducing atmosphere and plasma torch 18 is energized for one hundred to four hundred milliseconds in time duration and at a current of 1½ to 3 amps to create a discharge between the plasma torch and free end of tip 16 of tungsten support wire 12. This causes leg 16 to melt and form a ball at that end of leg 14 and, at the same time, provides enough heat to melt a small portion (i.e., 1–2 mm) of a lower melting refractory metal such as molybdenum wire 26 which melts and welds leg 14 to coil 28. The molybdenum wire used as welding material is brought into contact with the coil and support before the plasma torch is energized. In this example, which is an actual example used in making a lamp of the invention, between two and eight primary coils are shorted due to the molybdenum filling the space in between these coils by capillary action. This results in welding filament support assembly 10 directly to one of the secondary filament coil turns. By increasing the energy pulses from the plasma torch, the tungsten filament supports have been welded to secondary coil turns without the use of a lower melting refractory metal such as molybdenum. Similar supports made of molybdenum wire have also been brazed by melting the molybdenum directly onto the tungsten filament coil and have performed satisfactorily in lamps. Support wires of alloys of (i) tungsten and molybdenum and (ii) tungsten and rhenium have also been satisfactorily welded to tungsten filament coils.

The other end of filament support assembly 10 terminates in leg 20 containing a bead 24 made of a high silica content vitreous material which can withstand the chemical environment in the lamp and the high operating temperatures and which preferably has a melting point lower than the wall of the filament chamber. One example is a sealing glass which melts at a temperature slightly lower than the temperature of the vitreous material forming the filament chamber wall of the lamp and which has a thermal coefficient of expansion as close to the filament chamber wall material as possible to avoid or minimize thermal mismatch. In the case of a filament chamber or lamp envelope made of fused quartz, bead 24 can also be and has been made of fused quartz, but a lower melting seal glass is preferable. One particular seal glass composition that has been found particularly efficacious for use with the present invention in lamps having fused quartz filament chambers contains 82.5% $SiO_2$, 13.0% $B_2O_3$ and 4.5% $Al_2O_3$. This material is available from GE Lighting in Willoughby, Ohio, as a GS-3 graded seal glass and has a softening point of about 1100° C. as compared to the softening point of fused quartz which is about 1700° C. In the illustration shown, seal glass bead 24 is in the form of a cylinder having inner and outer diameters of 30 to 40 and 7 to 13 mils, respectively, and is 30 to 60 mils long. The end of tungsten leg 20 has been melted by means of a plasma torch or TIG welder (not shown) to form tungsten ball 22 which merely serves to hold bead 24 in place and keep it from slipping off leg 20 until assembly of the lamp is complete. In all cases it has been found convenient to assemble the bead onto the support wire prior to welding the support wire to a filament coil.

Figure 3B:
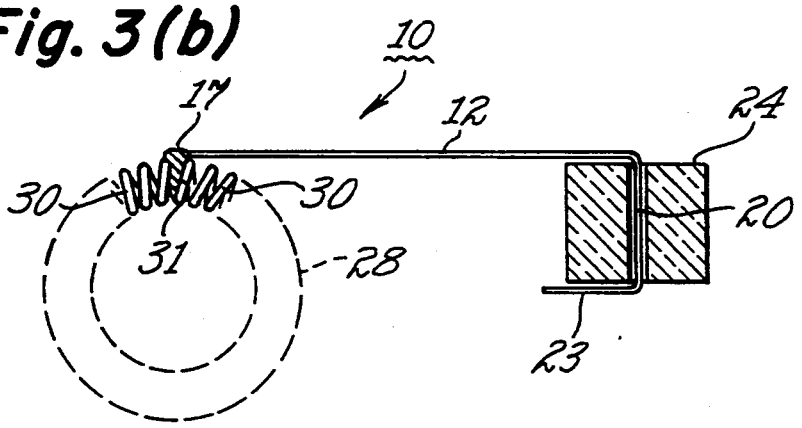

FIG. 3 schematically illustrates two additional methods by which the vitreous bead may be secured at that end of the filament support which contacts and is ultimately fused to the interior wall surface of the filament chamber. In FIG. 3(*a*) a plasma torch has been used to melt the end of a vitreous bead such as that shown in FIG. 2 over the end of leg 12. In FIG. 3(*b*) leg 20 terminates in leg 23 which is merely bent at roughly a right angle in order to secure vitreous bead 24 to the end of the filament support. In both of these figures, 17 represents a globule of metal as a result of the plasma welding and 31 represents two primary coil turns of a secondary filament coil filled with metal from the welding operation. Also, in some embodiments the longitudinal axis of the bead will be parallel to the longitudinal axis of the filament instead of perpendicular as illustrated in FIG. 3(*b*).

As previously stated, the filament support is be made of a suitable refractory metal such as tungsten, molybdenum, tantalum, rhenium, and alloys thereof and the like which can withstand the relatively hot temperatures of 3000° K. or more reached by the lamp filament during operation of the lamp without melting the support. The embodiments previously described are actual embodiments from which lamps have been successfully made and are meant to be illustrative, but non-limiting. Thus, the filament may be a single coil filament, a double coil or coiled-coil filament, or a triple coil filament.

As set forth above, tungsten filament support wires have also been welded directly to the filament coil using the procedure described above and as illustrated in FIG. 2 wherein tungsten support wire leg 16 is welded directly to the filament coil. However, it is more difficult to do this with the present state of technology than to employ another refractory metal of lower melting temperature, such as molybdenum, as a welding metal. Alternately, the support wire has also been made of molybdenum in which case leg 16 will be somewhat longer (i.e., 1.5 mm) and will melt down into one or two primary turns of coil 28. Lamps have also been successfully made employing a molybdenum support using this technique. Also, lamps using support wires made of a 74% tungsten –26% rhenium alloy have been successfully made. As used in the context of the invention, the term "welded" is meant to include all of these embodiments.

Turning next to FIGS. 4(*a*) and 4(*b*), there is illustrated a filament-molybdenum foil inlead assembly 32 containing two refractory metal supports 10, 10' welded to one of the secondary turns of linear coiled-coil filament 28. Filament supports 10, 10' each contain a vitreous seal glass bead 24, 24' secured to the other end. Filament 28 is secured by welding at each end to an alignment spud 34, 34' made of a suitable refractory metal (such as tungsten or molybdenum) as is disclosed in U.S. Pat. No. 4,942,311 as having one or more turns 35 from which extend leads 36 and 36'. The other legs 38 and 38' of the refractory metal spuds are welded to one end of respective molybdenum foils 40 and 40' with outer leads 42 and 42' being connected to the other end of sealing foils 40 and 40'. Thus, the spuds also function as leads and end supports for the filament. FIG. 4(*b*) illustrates assembly 32 after it has been inserted into an unsealed lamp assembly 52 which has been fabricated from fused quartz tubing as is disclosed, for example, in U.S. Pat. Nos. 4,810,932 and 5,045,798 the disclosures of which are incorporated herein by reference. In a typical example, an elliptical filament chamber whose dimensions are 10 mm OD and 22 mm long contain an 18 mm long coiled-coil tungsten filament 28. The inner diameter of tubular leg portions 46 is about 3 mm. Thus, it will be appreciated that the filament supports of the invention are able to be inserted through one of the tubular portions as part of the filament coil assembly and into the filament chamber without breaking the filament or support during this part of the lamp manufacturing process. After the filament is positioned in the filament chamber, the bead is melted onto the end of the support and fused to the interior surface of the filament chamber by laser fusion or heating with a torch. In the laser method, an infrared laser beam is pulsed on the bead through the fused quartz wall of the filament chamber which actually heats that portion of the support within the bead. In the torch method, two different approaches have been successfully used. In one approach the unfinished lamp containing the filament support and seal assembly is placed in a lamp lathe and rotated fast enough to insure that vitreous bead 24 is firmly adjacent the inner surface of filament chamber 48 and a torch is applied to the outside of the filament chamber in a position to heat that portion of the filament chamber sufficiently to partially melt and fuse bead 24 onto both filament support 10 and the interior wall surface of the filament chamber, thereby positively securing the filament support 10 to the wall of the filament chamber which, in turn, positively supports filament 28 with its linear axis substantially concentric with the linear optical axis of the filament chamber. In the other method, the lamp envelope is positioned so that the filament support or supports are vertical with the vitreous bead at the bottom adjacent the interior wall surface of the filament chamber. The torch is then applied to the outside surface of the chamber just under the bead to melt it to the chamber wall. After vitreous bead 24 has been secured to the interior surface of the filament chamber, the lamp assembly 52 is then evacuated, pumped, flushed and filled with the desired fill and sealed off by forming shrink seals 56, 56' (FIG. 1) over molybdenum foil seals 40 and 40'.

In some cases it has been found necessary to employ more than one filament support for the filament in such a lamp. Lamps according to this invention may be made with as many filament supports as are necessary and lamps have already been made with one and two filament supports securing the filament within the filament chamber. This also prevents the filament from sagging during operation of the lamp, particularly one that is rated at a high voltage. The support or supports also provide a more robust lamp in terms of vibration or shock sensitivity irrespective of whether the lamp operates at a low or high voltage and irrespective of whether or not an optical interference coating is on the filament chamber wall. This is an important benefit of the invention.

Figure 5:
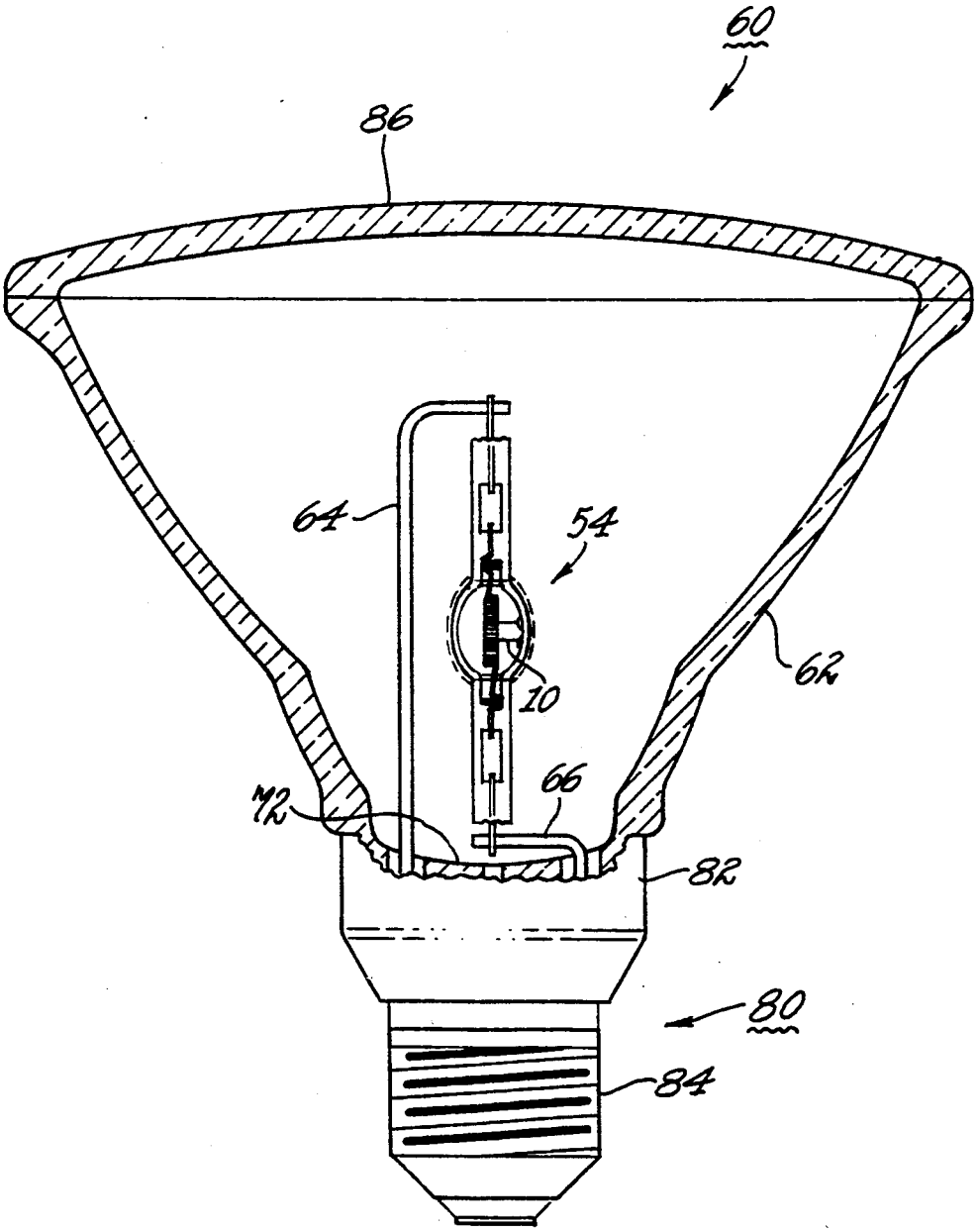
FIG. 5 schematically illustrates an incandescent lamp mounted in an parabolic reflector and having a filament supported according to the invention.

Lamp 54 containing filament support 10 as illustrated in FIG. 1 is shown assembled into a parabolic reflector lamp 60 illustrated in FIG. 5. Thus, turning to FIG. 5, reflector lamp 60 contains lamp 54 mounted into the bottom portion of parabolic glass reflector 62 by means of conductive mounting legs 64 and 66 which project through seals (not shown) at the bottom portion 72 of glass reflector 62. Lamp base 80 is crimped onto the bottom portion of the glass reflector by means not shown at neck portion 82. Screw base 84 is a standard screw base for screwing the completed assembly 60 into a suitable socket. Glass or plastic lens or cover 86 is attached or hermetically sealed by adhesive or other suitable means to the other end of reflector 62 to complete the lamp assembly.

The foregoing have been illustrative, but non-limiting examples of the practice of the invention. As will be appreciated by those skilled in the art, other configurations and lamp applications may be practiced, including tubular lamps such as conventional heat lamps and single-ended lamps of the type illustrated, for example in U.S. Pat. No. 4,918,353, the choice being left to the practitioner. Those skilled in the art will also appreciate that the invention is also applicable to lamps made of glass, including lower silica content glass.

What is claimed is:

1. An incandescent lamp comprising a light transmissive, vitreous envelope, said vitreous envelope having a filament chamber formed therein enclosing a filament constructed as a continuous coiled coil having a plurality of primary coils formed along a length of refractory metal and a plurality of larger secondary coils formed by coiling said length of primary coils, said filament being supported within said envelope by means of at least one refractory metal filament support welded to a portion of said plurality of primary coils on one of said secondary coils of said filament.

2. The lamp of claim 1 wherein said filament support is also secured to said envelope.

3. The lamp of claim 2 wherein said filament support is secured to said envelope by means of a vitreous bead.

4. The lamp of claim 3 wherein said bead is melted to said support and fused to said envelope.

5. The lamp of claim 4 wherein said filament has a linear axis and said envelope has a linear optical axis and wherein said filament axis is coincident with said optical axis.

6. The lamp of claim 5 wherein an optical interference coating is disposed on a surface of said filament chamber.

7. The lamp of claim 6 wherein said coating reflects infrared radiation but transmits visible light radiation.

8. The lamp of claim 4 wherein said bead has a melting point lower than that of said vitreous envelope.

9. The lamp of claim 7 wherein said bead has a melting point lower than that of said vitreous envelope.

10. The lamp of claim 1 wherein said refractory metal comprises tungsten, molybdenum, tantalum, rhenium or alloys thereof.

11. The lamp of claim 10 wherein said refractory metal is selected from the group consisting essentially of tungsten, molybdenum, tantalum, rhenium and alloys thereof.

12. The lamp of claim 1 wherein said support is not welded to an end of said filament.

13. The lamp of claim 12 wherein said support does not conduct electricity to said filament.

14. An incandescent lamp comprising a light transmissive vitreous envelope having a filament chamber which has a linear optical axis and which encloses within a linear filament constructed as a continuous coiled coil having a plurality of primary coils formed along a length of refractory metal and a plurality of larger secondary coils formed by coiling said length of primary coils and whose linear axis is coincident with said linear optical axis of said filament chamber, with said filament supported within said chamber by means of at least one refractory metal filament support, with one part of said support welded to a portion of said plurality of primary coils on one of said secondary coils of said filament and another part of said support attached to a bead of vitreous material which has been melted to said another part of said support and fused to the inside surface of said filament chamber.

15. The lamp of claim 14 wherein said filament chamber has two ends disposed apart from each other and wherein each of said ends terminates in an elongated tubular portion having a diameter substantially smaller than the maximum diameter of said filament chamber.

16. The lamp of claim 15 wherein said support is selected from the group consisting essentially of tungsten, molybdenum, tantalum, rhenium and alloys thereof.

17. The lamp of claim 16 wherein an infrared reflecting coating is disposed on at least a portion of said filament chamber.

18. A filament assembly comprising a continuous coiled coil filament constructed having a plurality of primary coils formed along a length of refractory metal and a plurality of larger secondary coils formed by coiling said length of primary coils and with at least one refractory metal support welded to a portion of said plurality of primary coils on one of said secondary coils of said filament.

19. The assembly of claim 18 wherein said filament comprises tungsten.

20. The assembly of claim 19 wherein said support is selected from the group consisting essentially of tungsten, molybdenum, tantalum, rhenium and alloys thereof.

21. A double-ended halogen-incandescent lamp comprising a vitreous, light-transmissive envelope having a double-ended filament chamber of a predetermined generally elliptical shape having two ends and terminating at each of said ends in an elongated tubular portion having a diameter smaller than the diameter of said chamber, wherein said chamber has a linear optical axis and is coated with an infrared-reflecting and visible light-transmitting coating, said chamber enclosing within a linear continuous filament having a plurality of primary coils formed along the length thereof and a plurality of secondary coils formed by coiling said length of primary coils and one or more halogen compounds and inert gas, wherein said filament is aligned in said chamber with its longitudinal axis coincident with said optical axis of said chamber, said filament supported within said chamber by means of at least one refractory metal support welded to a portion of said plurality of primary coils on one of said secondary coils of said filament and wherein a vitreous bead is melted to said support and to the interior surface of said chamber to support said filament within said chamber.

22. The lamp of claim 21 wherein said support does not conduct electricity to said filament.

23. The lamp of claim 22 wherein said bead has a melting temperature lower than that of said chamber.

24. A double-ended halogen-incandescent lamp comprising:

(a) a vitreous light-transmissive envelope having a double-ended filament chamber of a predetermined generally elliptical shape having two ends and a linear optical axis, each of said ends terminating in an elongated tubular portion having a diameter smaller than the diameter of said chamber, wherein said chamber is coated with an infrared-reflecting and visible light-transmitting coating;

(b) a Linear filament enclosed in said chamber and having a plurality of primary coils formed along the length thereof and a plurality of secondary coils formed by coiling said length of primary coils;

(c) one or more halogen compounds and inert gas enclosed in said chamber;

(d) at least one refractory metal support attached to said filament a predetermined distance from ends of said filament to significantly reduce sagging and provide substantial radial alignment of a longitudinal axis of said filament coincident with said optical axis of said chamber, wherein said support is effective to maintain said filament in a position to achieve substantial conversion of infrared radiation reflected back to said filament by said coating to visible light radiation; and (e) wherein said support is welded to a portion of said plurality of primary coils on one of said secondary coils.

25. The lamp of claim 24 wherein said support is secured to said envelope by means of a vitreous bead.

* * * * *